US008011966B1

(12) United States Patent
Tang et al.

(10) Patent No.: US 8,011,966 B1
(45) Date of Patent: Sep. 6, 2011

(54) STRUCTURE OF HIGH SPEED CONNECTOR

(75) Inventors: Chun-Yuan Tang, Shenzhen (CN); Bin Di, Shenzhen (CN); Xiao-Song Guo, Shenzhen (CN)

(73) Assignee: Amphenol East Asia Electronic Technology (Shenzhen) Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 12/725,471

(22) Filed: Mar. 17, 2010

(51) Int. Cl.
*H01R 25/00* (2006.01)

(52) U.S. Cl. ..... 439/638; 439/79

(58) Field of Classification Search ..... 439/79, 439/540.1, 607.11, 607.32, 637, 638, 639, 439/660
See application file for complete search history.

(56) References Cited

U.S. PATENT DOCUMENTS 6,663,434 B1 * 12/2003 Wu ..... 439/638
6,896,556 B1 * 5/2005 Wu ..... 439/638
7,540,784 B1 * 6/2009 Zhang et al. ..... 439/638
7,654,873 B2 * 2/2010 Luo et al. ..... 439/731
7,744,427 B2 * 6/2010 Zhang et al. ..... 439/660

* cited by examiner

*Primary Examiner* — Thanh-Tam T Le
(74) *Attorney, Agent, or Firm* — Leong C. Lei

(57) ABSTRACT

A high speed connector includes a male connector portion and a female connector portion. The male connector portion includes a male-portion housing and high-speed male terminals and other male terminals received in the male-portion housing. The female connector portion includes a female-portion housing and high-speed female terminals and other female terminals received in the female-portion housing. The high-speed male and female terminals both include a fixing section for fixing the terminals in the respective housings. The high-speed male and female terminals both include flat-structured terminals and deviated-structured terminals. The fixing section of the flat-structured terminal is located on the same plane as other sections of the terminal, while the fixing section of the deviated-structured terminal is deviated sidways with respect to the other sections. Such an alternating arrangement allows the connector to be minatruized and interference and loss of signals transmitted therethrough are reduced.

20 Claims, 11 Drawing Sheets

STRUCTURE OF HIGH SPEED CONNECTOR

(a) TECHNICAL FIELD OF THE INVENTION

The present invention generally relates to a structure of connector, and more particularly to a connector structure that realizes a transmission speed of at least 6 Gb/s.

(b) DESCRIPTION OF THE PRIOR ART

A known hard disk connector comprises a male connector portion and a female connector portion as shown in FIGS. 1 and 2 of the attached drawings. Terminals 2 are embedded in a connector housing 1. Each terminal 2 is fixed by interference fitting between a fixing section 20 thereof and a terminal slot defined in the connector housing 1. The fixing section 20 is of the greatest width of the terminal 2. With a demand for increased transmission speed between an electronic device and a connector and a demand for reduction of the size of a connector, the spacing between fixing sections of adjacent terminals is getting decreased. However, due to the need for the structure of the fixing section, the terminal cannot be further reduced in respect of the width thereof, making the current structure of connector not suiting the need for high speed transmission of the current electronic devices, such as a newly developed SAS hard disk drive. The problem is simply due to the fact that the known terminal adopt a straight structure, which makes the widest portions (the fixing sections) of all the terminals located on the same plane. This leads to a situation where the spacing between the terminals is proportionally reduced with the increase of distribution density of the terminals.

In view of the above discussed problem, it is desired to have a structure of high speed connector to overcome such a problem.

SUMMARY OF THE INVENTION

An objective of the present invention is to overcome the above drawback of the existing technology by providing a structure of high speed connector that realizes a transmission speed of at least 6 Gb/s.

The technical feature of the high speed connector according to the present invention is as follows. The structure of the high speed connector comprises a male connector portion and a female connector portion. The male connector portion comprises a male-portion housing and high-speed male terminals and other male terminals received in the male-portion housing. The female connector portion comprises a female-portion housing and high-speed female terminals and other female terminals received in the female-portion housing. The high speed connector of the present invention is characterized in that the high-speed male terminals comprise an engagement section for electrically engaging the high-speed female terminals, a fixing section for fixing the male terminals in the male-portion housing, and a bent section for electrically connecting a circuit board. The high-speed male terminals include flat-structured male terminals and deviated-structured male terminals. The fixing section and engagement section of the flat-structured male terminals are located on the same plane. The fixing section of the deviated-structured male terminals is deviated sidways with respect to the engagement section. The high-speed female terminals comprise a top tip section, a resiliently pressing section for electrically engaging the high-speed male terminals, a fixing section for fixing the female terminals in the female-portion housing, and a bent section for electrically connecting a circuit board. The high-speed female terminals include substantially-flat-structured female terminals and deviated-structured female terminals. The fixing section of the substantially-fiat-structured female terminals is located on a reference plane on which the top tip section is located. The fixing section of the deviated-structured female terminals is deviated sideways with respect to the reference plane on which the top tip section is located.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
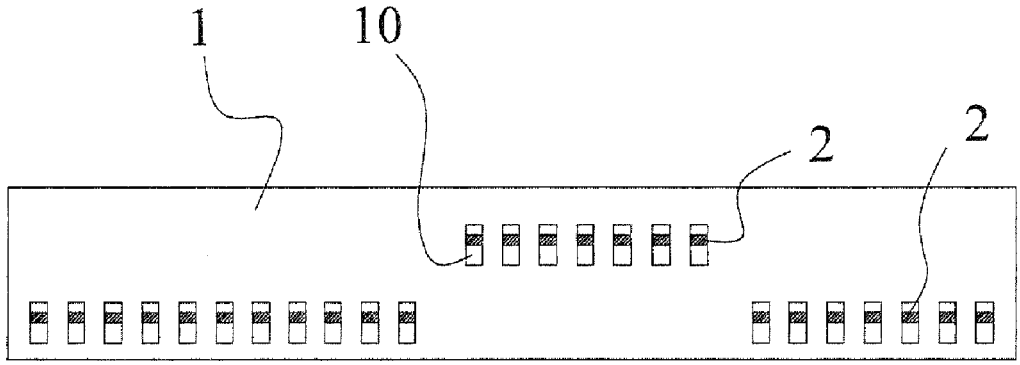
FIG.1 PRIOR ART
FIG. 1 is a cross-sectional view showing terminals of a conventional connector received in a housing of the connector.
Figure 2:
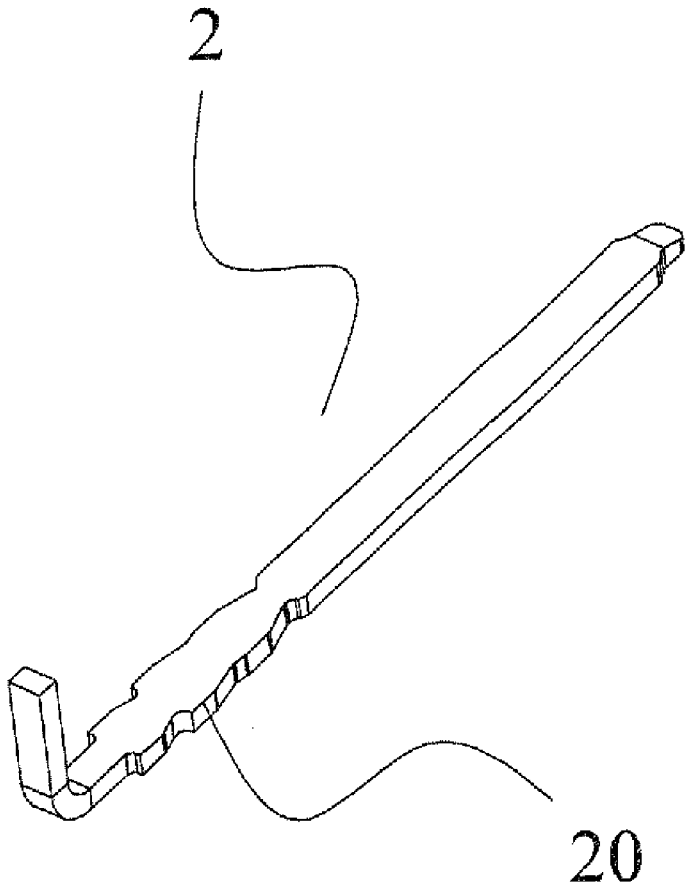
FIG.2 PRIOR ART
FIG. 2 is a perspective view showing a conventional male terminal of a connector.
Figure 3:
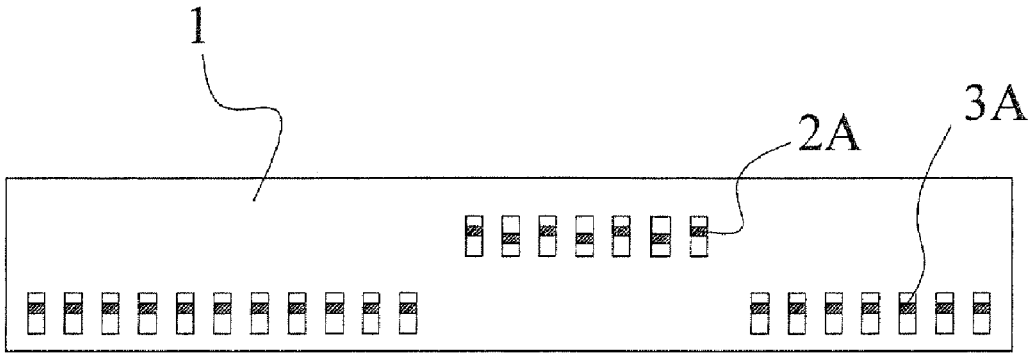
FIG. 3 is a cross-sectional view showing terminals of a high speed connector according to the present invention received in a connector housing.
Figure 4:
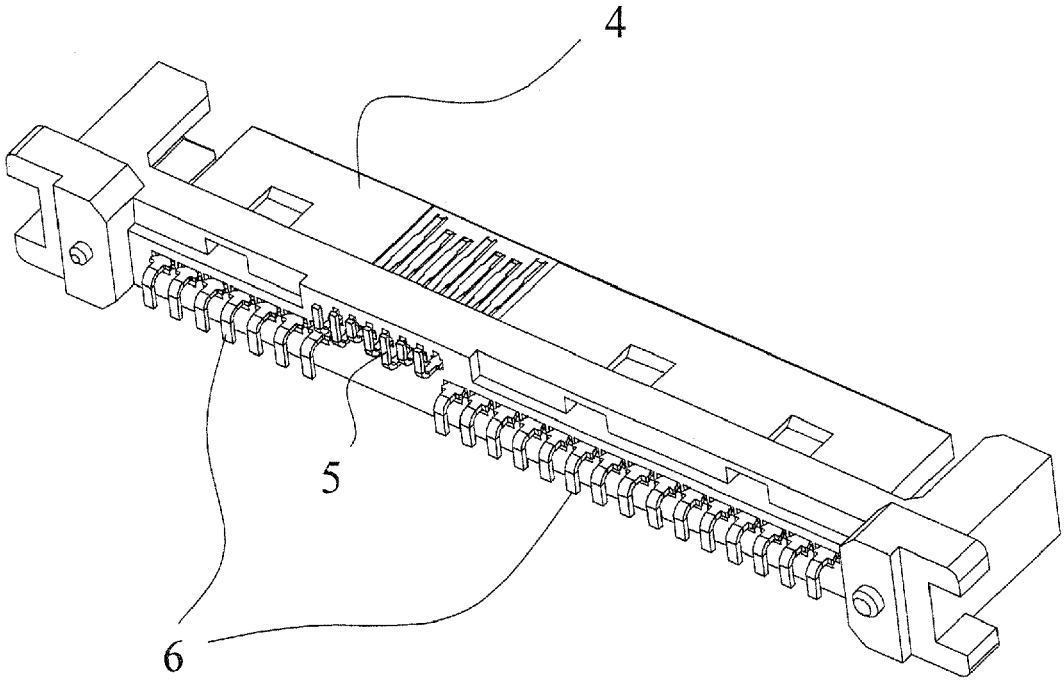
FIG. 4 is a perspective view of a male connector portion of an SAS hard disk connector according to the present invention.
Figure 5:
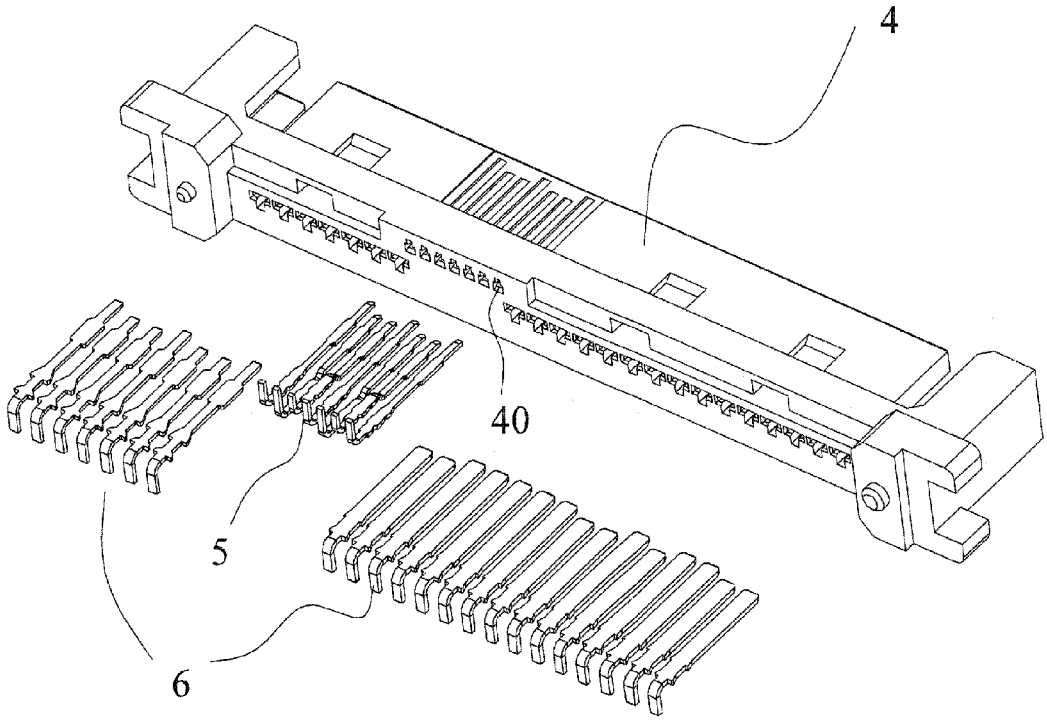
FIG. 5 is an exploded view of the embodiment of FIG. 4.
Figure 6:
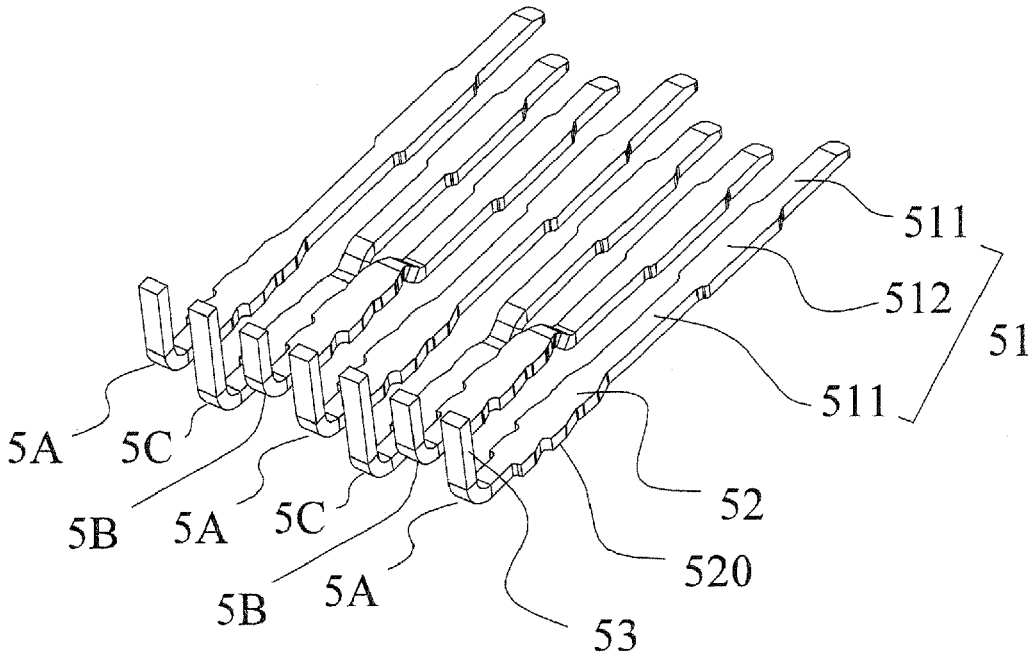
FIG. 6 is a perspective view showing high-speed male terminals of the embodiment of FIG. 4.
Figure 7:
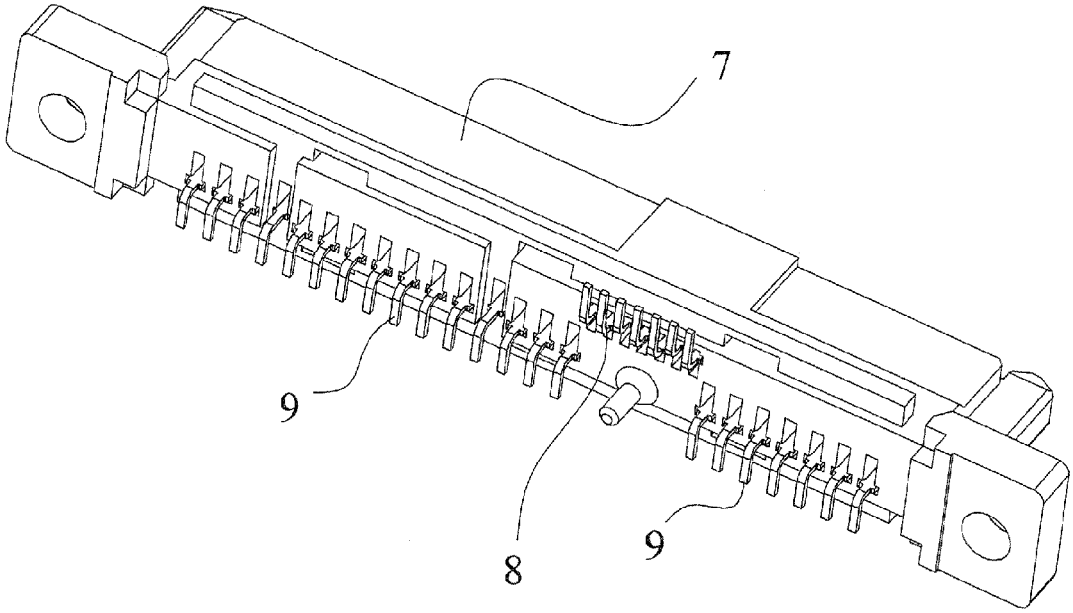
FIG. 7 is a perspective view of a female connector portion of the SAS hard disk connector according to the present invention.
Figure 8:
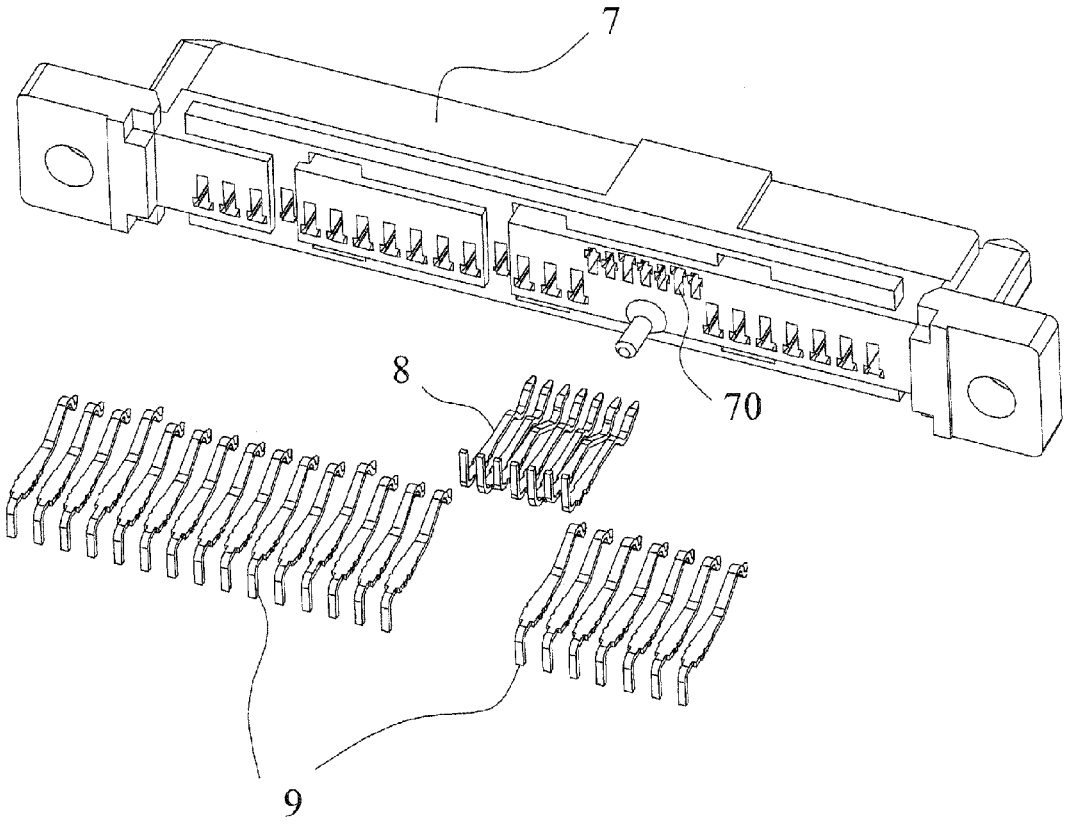
FIG. 8 is an exploded view of the embodiment of FIG. 7.
Figure 9:
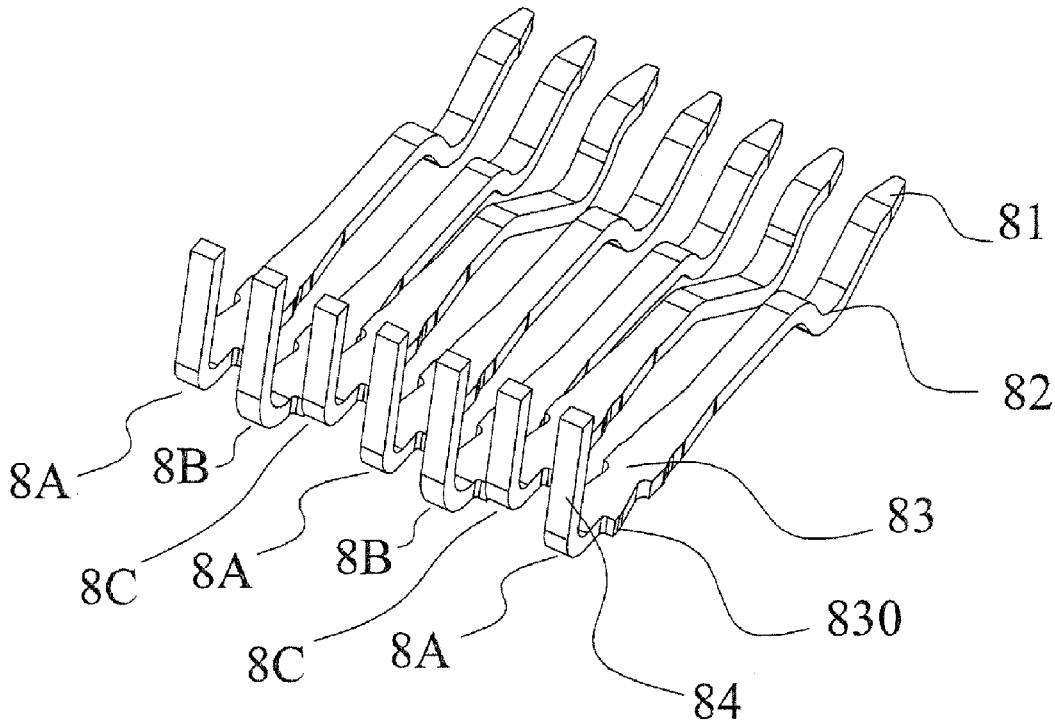
FIG. 9 is a perspective view showing high-speed female terminals of the embodiment of FIG. 7.

As shown in FIG. 3, the present invention provides a structure of high speed connector, wherein high-speed terminals 2A that are embedded in a connector body 1 are arranged in an alternating manner so as to increase the spacing between adjacent terminas and thus realizing a miniaturized configuration of the connector while meeting the requirement of high speed transmission. In the following, an embodiment of the present invention of which an example is given to a SAS hard disk connector will be described with reference to the accompanying drawings. The SAS hard disk connector comprises a male connector portion (as shown in FIGS. 4 and 5) and a female connector portion (as shown in FIGS. 7 and 8). The male connector portion comprises a male-portion housing 4 and high-speed male terminals 5 and other male terminals 6 that are received in the male-portion housing 4. The female connector portion comprises a female-portion housing 7 and high-speed female terminals 8 and other female terminals 9 that are received in the female-portion housing 7. The high-speed male terminals 5 comprises an engagement section 51 for electrically engaging the high-speed female terminals 7, a fixing section 52 for fixing the high-speed male terminals 5 in the male-portion housing 4, and a bent section 53 for electrically connecting a circuit board. The high-speed male terminals 5 include flat-structured male terminals 5A and deviated-structured male terminals 5B, 5C. (In the instant embodiment, seven high-speed male terminals are provided, wherein, counting from left to right, the first, the fourth, and the seventh high-speed male terminals are flat-structured male terminals 5A, the third and the sixth high-speed male terminals are deviated-structured male terminals 5B that are deviated outward, and the second and the fifth high-speed male terminals are deviated-structured male terminals 5C that are deviated inward. With such an alternating arrangement of the flat-structured male terminals and the deviated-structured male terminals, the spacing between the fixing sections of the male terminals that have the greatest width in order to realize the objective of the present invention.) The fixing section 52 and the engagement section 51 of the flat-structured male terminals 5A are set on the same plane, while the fixing sections 52 of the deviated-structured male terminals 5B, 5C are respectively deviated outward and inward with respect to the engagement sections 51 ("inward" and "outward" being defined with respect to the positions where the male terminals are set inside the male-portion housing).

Figure 11:
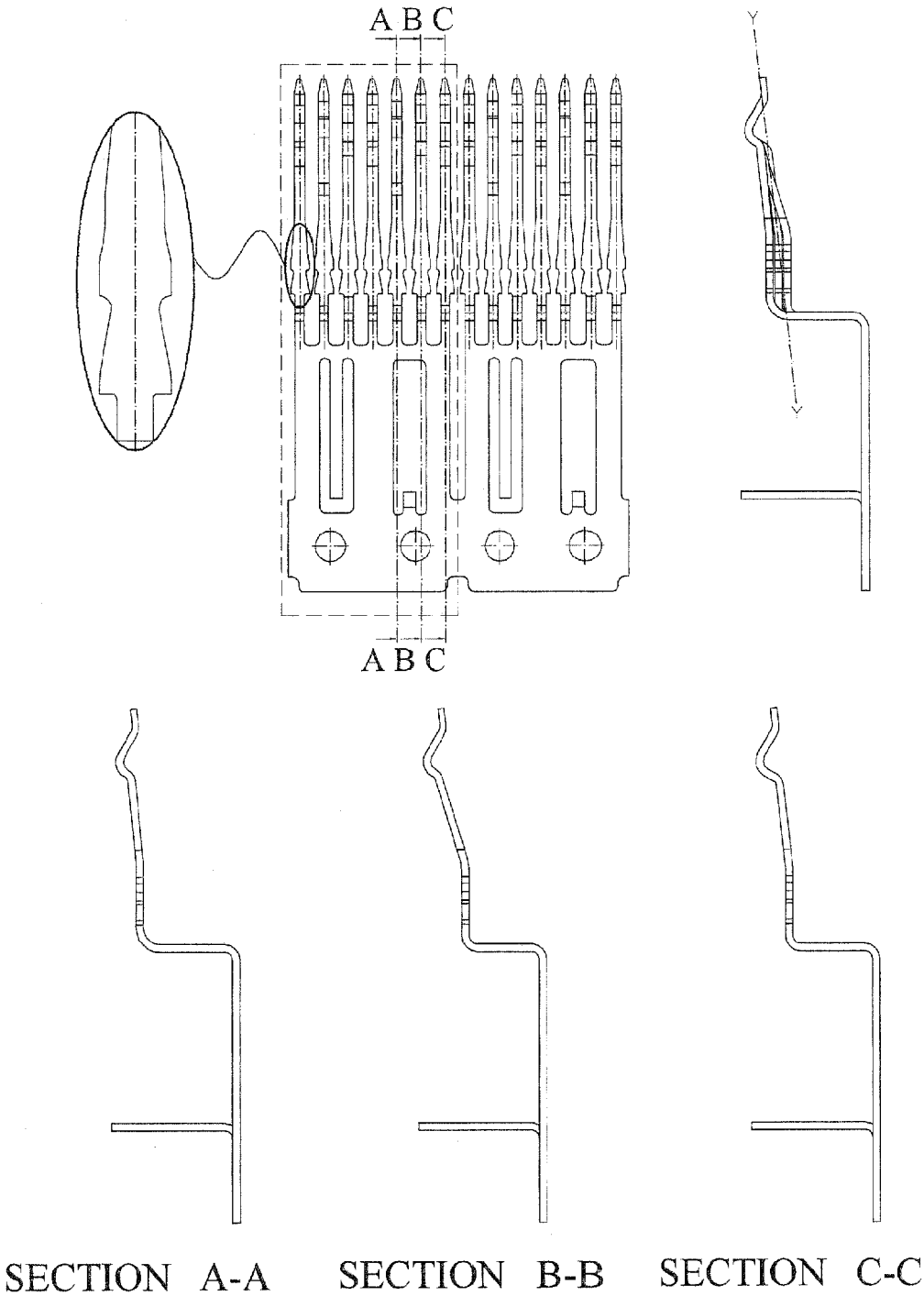
FIG. 11 is a parts drawing showing a female terminal blank for the high-speed female terminals of the embodiment shown in FIG. 7/

The high-speed female terminals 8 comprises a top tip section 81, a resiliently pressing section 82 for electrically engaging the high-speed male terminals 5, a fixing section 83 for fixing the high-speed female terminals 8 in the female-portion housing 7, and a bent section 84 for electrically connecting a circuit board. The high-speed female terminals 8 include substantially-flat-structured female terminals 8A and deviated-structured female terminals 8B, 8C. The fixing section 83 of the substantially-flat-structured female terminals 8C are located on the reference plane YY on which the top tip section 81 is located (as shown in FIG. 11). The fixing sections 83 of the deviated-structured female terminals 8B, 8C are respectively deviated outward and inward with respect to the reference plane YY on which the top tip sections 81 are located ("inward" and "outward" being defined with respect to the positions where the female terminals are set inside the female-portion housing).

The engagement section 51 of the high-speed male terminals 5 comprises a reduced portion 511 and an expanded portion 512, wherein the expanded portion constitutes a zone where the high-speed male terminal and a respective high-speed female terminal engage each other when the connector is set in a connected condition.

The male-portion housing 4 forms male terminal slots for respectively receiving and retaining the male terminals therein, wherein the male terminal slots that receive and retain the high-speed male terminals are referred to as high-speed male terminal slots 40. The fixing section 52 of the male terminals forms a projection 520 for interference fitting with the respective high-speed male terminal slot 40. (It is feasible to provide more than one projection and three such projections are provided in the instant embodiment.) The female-portion housing 7 forms female terminal slots for respectively receiving and retaining the female terminals, wherein the female terminal slots that receive and retain the high-speed female terminals 8 are referred to as high-speed female terminal slots 70. The fixing section 83 of the high-speed female terminals 8 forms a projection 830 for interference fitting with the respective high-speed female terminal slot 70. The connector of the instant embodiment is provided for an SAS port (SAS hard disk drive), which may reslize a data transmission speed of at least 6 Gb/s. The spacing between adjacent ones of the high-speed male terminals or the high-speed female terminals is 0.8 mm, and advanced designs may allow the spacing to reduce to be as small as 0.6 mm.

Figure 10:
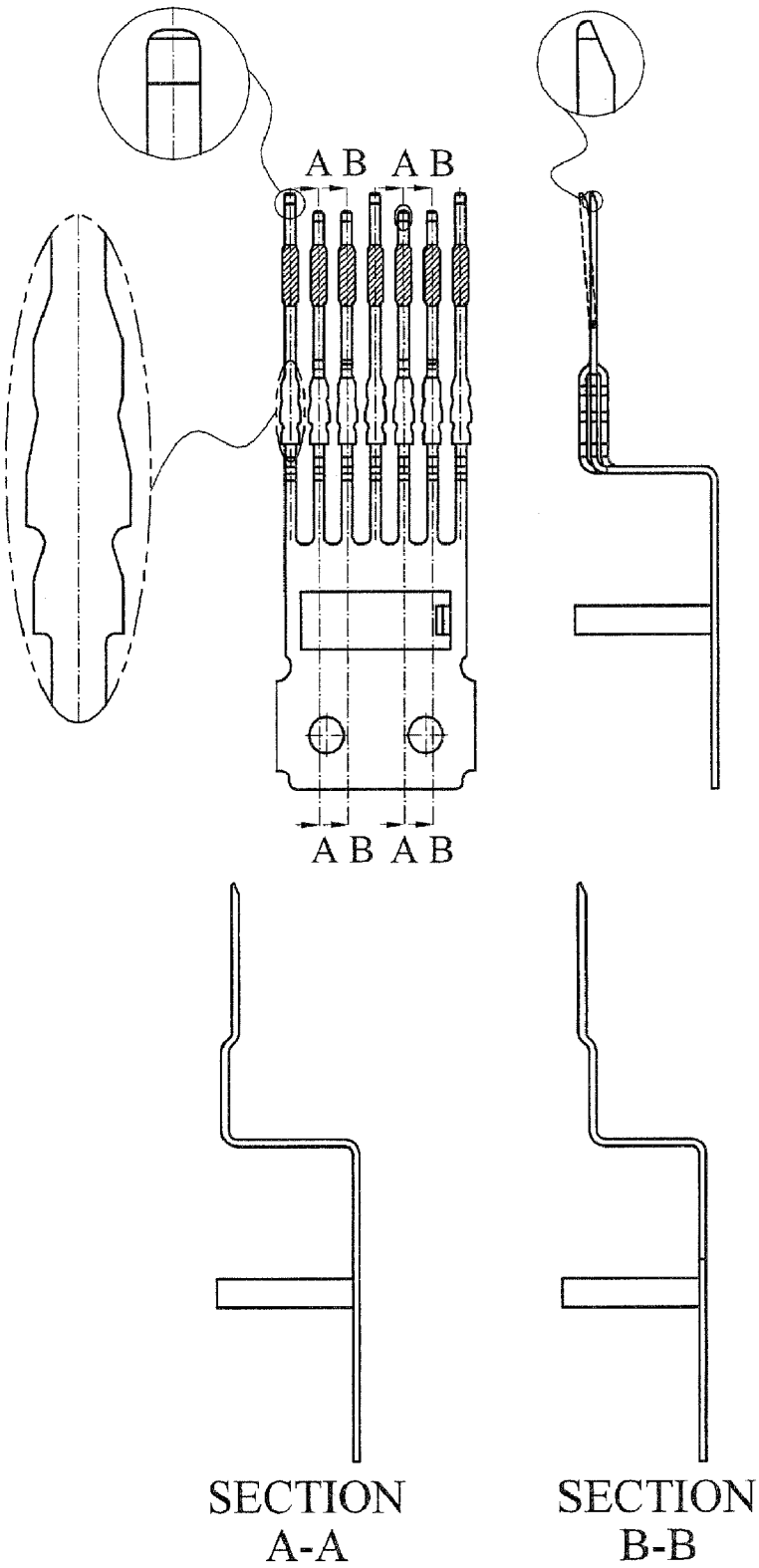
FIG. 10 is a parts drawing showing a male terminal blank for the high-speed male terminals of the embodiment shown in FIG. 4.

FIG. 10 shows a parts drawing for an intermeidately-processed part, male terminal blank, for making high-speed male terminals. The seven high-speed male terminals (the number being variable depending on the practical application) for the same male connector portion are formed on the same blank plate, while the male terminal blank is formed with a plate of a greater size. In other words, in such a great-size plate, a plurality of male terminal blanks are formed and subsequently cut into individual male terminal blank.

FIG. 11 shows a parts drawing for an intermediately-processed part, female terminal blank, for making high-speed female terminals. The seven high-speed female terminals (the number being variable depending on the practical application) for the same female connector portion are formed on the same blank plate, while the female terminal blank is formed with a plate of a greater size. In other words, in such a great-size plate, a plurality of female terminal blanks are formed and the processing can be further carried out.

To conclude, the present invention adopts a deviated arrangement for the fixing sections of the male terminals or the female terminals to reduce the spacing between the terminals but the spacing between the fixing sections that are of the greatest width remains the same or is even increased, whereby interference and loss of signals of the terminals can be reduced. Reduction of the engagement section of the male terminals further increases the transmission speed that can be realized by the present invention and ensure stable performance. The transmission speed can be increased to at least 6 Gb/s.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A high speed connector, comprising a male connector portion and a female connector portion, the male connector portion comprising a male-portion housing and high-speed male terminals and other male terminals received in the male-portion housing, the female connector portion comprising a female-portion housing and high-speed female terminals and other female terminals received in the female-portion housing, characterized in that the high-speed male terminals comprise an engagement section for electrically engaging the high-speed female terminals, a fixing section for fixing the male terminals in the male-portion housing, and a bent section for electrically connecting a circuit board, the high-speed male terminals including flat-structured male terminals and deviated-structured male terminals, the fixing section and engagement section of the flat-structured male terminals being located on the same plane, the fixing section of the deviated-structured male terminals being deviated sideways with respect to the engagement section, the high-speed female terminals comprising a top tip section, a resiliently pressing section for electrically engaging the high-speed male terminals, a fixing section for fixing the female terminals in the female-portion housing, and a bent section for electrically connecting a circuit board, the high-speed female terminals including substantially-flat-structured female terminals and deviated-structured female terminals, the fixing section of the substantially-flat-structured female terminals being located on a reference plane on which the top tip section is located, the fixing section of the deviated-structured female terminals being deviated sideways with respect to the reference plane on which the top tip section is located.

2. The high speed connector according to claim 1, characterized in that the fixing section of the deviated male terminals are deviated inward/outward with respect to the engagement section.

3. The high speed connector according to claim 1, characterized in that the fixing section of the deviated female terminals are deviated inward/outward with respect to the top tip section.

4. The high speed connector according to claim 1, characterized in that the engagement section of the high-speed male terminals comprises a reduced portion and an expanded portion.

5. The high speed connector according to claim 2, characterized in that the engagement section of the high-speed male terminals comprises a reduced portion and an expanded portion.

6. The high speed connector according to claim 3, characterized in that the engagement section of the high-speed male terminals comprises a reduced portion and an expanded portion.

7. The high speed connector according to claim 1, characterized in that the male-portion housing forms male terminal slots for respectively receiving and retaining the male terminals, the fixing section of the male terminals forming a projection for interference fitting with the respective male terminal slot.

8. The high speed connector according to claim 2, characterized in that the male-portion housing forms male terminal slots for respectively receiving and retaining the male terminals, the fixing section of the male terminals forming a projection for interference fitting with the respective male terminal slot.

9. The high speed connector according to claim 3, characterized in that the male-portion housing forms male terminal slots for respectively receiving and retaining the male terminals, the fixing section of the male terminals forming a projection for interference fitting with the respective male terminal slot.

10. The high speed connector according to claim 1, characterized in that the female-portion housing forms female terminal slots for receiving and retaining female terminals, the fixing section of the female terminals forming a projection for interference fitting with the respective female terminal slot.

11. The high speed connector according to claim 2, characterized in that the female-portion housing forms female terminal slots for receiving and retaining female terminals, the fixing section of the female terminals forming a projection for interference fitting with the respective female terminal slot.

12. The high speed connector according to claim 3, characterized in that the female-portion housing forms female terminal slots for receiving and retaining female terminals, the fixing section of the female terminals forming a projection for interference fitting with the respective female terminal slot.

13. The high speed connector according to claim 1, characterized in that the connector is applied to an SAS port.

14. The high speed connector according to claim 2, characterized in that the connector is applied to an SAS port.

15. The high speed connector according to claim 3, characterized in that the connector is applied to an SAS port.

16. The high speed connector according to claim 1, characterized in that the high-speed male terminals and high-speed female terminals provide a data transmission speed of at least 6 Gb/s.

17. The high speed connector according to claim 2, characterized in that the high-speed male terminals and high-speed female terminals provide a data transmission speed of at least 6 Gb/s.

18. The high speed connector according to claim 3, characterized in that the high-speed male terminals and high-speed female terminals provide a data transmission speed of at least 6 Gb/s.

19. An SAS hard disk connector, characterized by comprising a male connector portion and a female connector portion claimed in claim 1.

20. The SAS hard disk connector according to claim 19, characterized in that quantities of the high-speed male terminals and the high-speed female terminals are 5-10, spacing between the high-speed male terminals being 0.6 mm to 1 mm, spacing between the high-speed female terminals being 0.6 mm to 1 mm.

* * * * *